United States Patent [19]

Pontini

[11] 4,449,390

[45] May 22, 1984

[54] AUTOMATIC UNIT FOR HOT MOLDING AND TRIMMING OF METAL PARTS

[75] Inventor: Giovanni Pontini, Turin, Italy

[73] Assignee: Teksid, S.p.A., Turin, Italy

[21] Appl. No.: 330,070

[22] Filed: Dec. 14, 1981

[30] Foreign Application Priority Data

Dec. 29, 1980 [IT] Italy ..... 69005 A/80

[51] Int. Cl.[3] ..... B21J 9/00

[52] U.S. Cl. ..... 72/405; 29/34 R; 29/563; 72/422

[58] Field of Search ..... 29/563, 34 R; 198/486; 414/152, 153, 744 A, 751; 72/421, 420, 422, 405, 24; 425/126 R, 126 S, 403, 397, 422, 444, 436 R, 436 RM

[56] References Cited

U.S. PATENT DOCUMENTS

| | | | |
|---|---|---|---|
| 3,079,817 | 3/1963 | Sanford | 72/405 |
| 3,165,766 | 1/1965 | Wisebaker | 72/405 X |
| 3,512,391 | 5/1970 | Bozich | 72/405 X |
| 3,630,391 | 12/1971 | Wilson | 414/744 A |
| 3,824,833 | 7/1974 | Bachmann | 414/744 A X |
| 3,831,425 | 8/1974 | Kita | 72/421 X |
| 4,272,978 | 6/1981 | Berecz | 72/421 X |
| 4,299,529 | 11/1981 | Inaba et al. | 414/744 A X |

OTHER PUBLICATIONS

Kuka Advertisement in *The Engineer,* 3/29/79, p. 10, Kuka Uk Ltd, 7 Union Street, Bedford, Mk 40 2SF.

*Primary Examiner*—William R. Briggs
*Assistant Examiner*—Cawrence Meier
*Attorney, Agent, or Firm*—Alan H. Levine

[57] ABSTRACT

An automatic unit for hot molding, e.g., forging or stamping, and subsequent trimming of metal parts. A molding press and a trimming press are served by two robot pairs. One robot of one pair delivers hot ingots to the molding press, the other pair of robots moves the part being molded step-by-step through successive stampings, and the other robot of the first pair delivers the fully molded part to the trimming press. The robots of the second pair move in mirror-image relation. The ends of the robot arms of the second pair are accommodated by depressions in the molds during the various stamping operations.

4 Claims, 3 Drawing Figures

6
5
5a
21
22
17
19
18
20
26
28
27
27a
31
30
29
32
33
24
24a
25
23
16
15
13
14
12
11
A
9
10
A
34
33a
35
32a
32
36
33
37

AUTOMATIC UNIT FOR HOT MOLDING AND TRIMMING OF METAL PARTS

At the present time, molding or forging of metallic parts by means of mechanical presses is effected by a manual process. An operator at a press draws, with suitable tongs, an ingot or crop end coming from the furnace and heated to a suitable temperature (1200° C.), positions the ingot with respect to a stationary mold part, at a first mold station, and then thereafter actuates the press to preform the part. Subsequently, the press ram is raised so that the operator, with the use of suitable tongs, seizes the preformed piece and passes it to a second mold station, and thereafter repeats the press closing operation. The final forming of the part is generally effected within a third and last station of the mold.

After the third opening of the press, the part is manually withdrawn and sent to a trimming station by means of a suitable carrier.

Each of the three actuations of the press, i.e., at the end of each molding cycle, the operator maneuvers a pedal control which actuates a device provided with one or more blowpipes which emit a mixture of water and graphite for cleaning, lubricating, and partial cooling of the mold.

Thereafter, the operative cycle restarts.

The manual cycle phases present evident drawbacks, such as:

thermic irradiations, generated by the temperature of the worked part, reach the operator even if he is working at the distance made possible by the length of the tongs;

vibrations to which the operator is submitted;

fatigue of the operator, and related problems concerning the ergonomics of the particular working place;

the noise produced by the operation which assaults the operator;

ambiant pollution caused by the slag dust and the vapors generated by the vaporization of the liquid used for cleaning of the molding; and the intrinsic danger of the system comprising the various operations for the pedal actuation and manoeuvre of the part.

The main object of the invention is to provide a totally automatic molding or forging unit wherein the repetitive cycle of the various operations is effected by automatons, i.e., "robots". The unit excludes completely the use of humans, except a specialized operator who controls an electronic central station from which the necessary impulses for the automatic actuation of the operative cycle are sent.

With the stated object in view, one of the particular features of the automatic unit according to the invention resides in the various phases forming the operative cycle being effected by mechanical units which are controlled by appropriately programmed electronic microprocessors.

More specifically, the automatic unit according to the invention is characterized by the press being served by four automatons, or "robots", located one on each side of the machine and operating sequentially so as to effect all the operations that, in the presently known technique, are made by human operators.

Another particular feature of the unit according to the invention consists in two of the juxtaposed robots being operative to work in synchronism, interdependently, and effect the translation of the part from one to another station through which the molding cycle is effected. The other robot pair, an interlocking couple, is located perpendicular to the first pair and programmed to provide a robot which draws the block coming from the furnace and lays it on the stationary plane of the mold, the other robot being provided for drawing of the molded part, lifted from the mold plane, and carrying it between the planes of the trimming machine from which the trimmed part is sent to be heat treated. This robot provides further for drawing of the excess material coming from the trimming operation and discharging it onto the conveyor belt.

Another particular feature of the unit resides in the two robots, one intended for drawing the block and the other for transporting the molded part to the trimming machine, being provided with a pair of arms, opposed at 180° to each other. The arms are provided with pneumatically activated terminal pliers which may be operated in a reciprocating rotational movement around their own vertical axis within an angle of 180°. Both the operator robots which follow the part in the molding phases are provided with a single arm, having terminal pliers, capable of making reciprocating movements in a vertical plane. All the robots are capable of making translational movement of a programmed amplitude with respect to columns having a horizontal axis and parallel to the vertical frontal plane of the press.

Another particular feature of the unit resides in the fact that in the mold upper and lower planes, in whose facing surfaces the negative shapes of the part to be molded are formed, on the sides exposed towards the operator robots, cavities are formed which are symmetrically juxtaposed and adapted to receive the ends of the terminal pliers carried by the robot arms.

Another particular feature of the unit resides in the structure of the press frame which, in order to allow the access to, and manoeuvre of, the four robots, is open on all four sides.

Additional particular features of the automatic unit according to the invention are described below with reference to the accompanying schematic drawings, which are annexed only for illustrative purposes, and wherein.

Figures 1, 4:
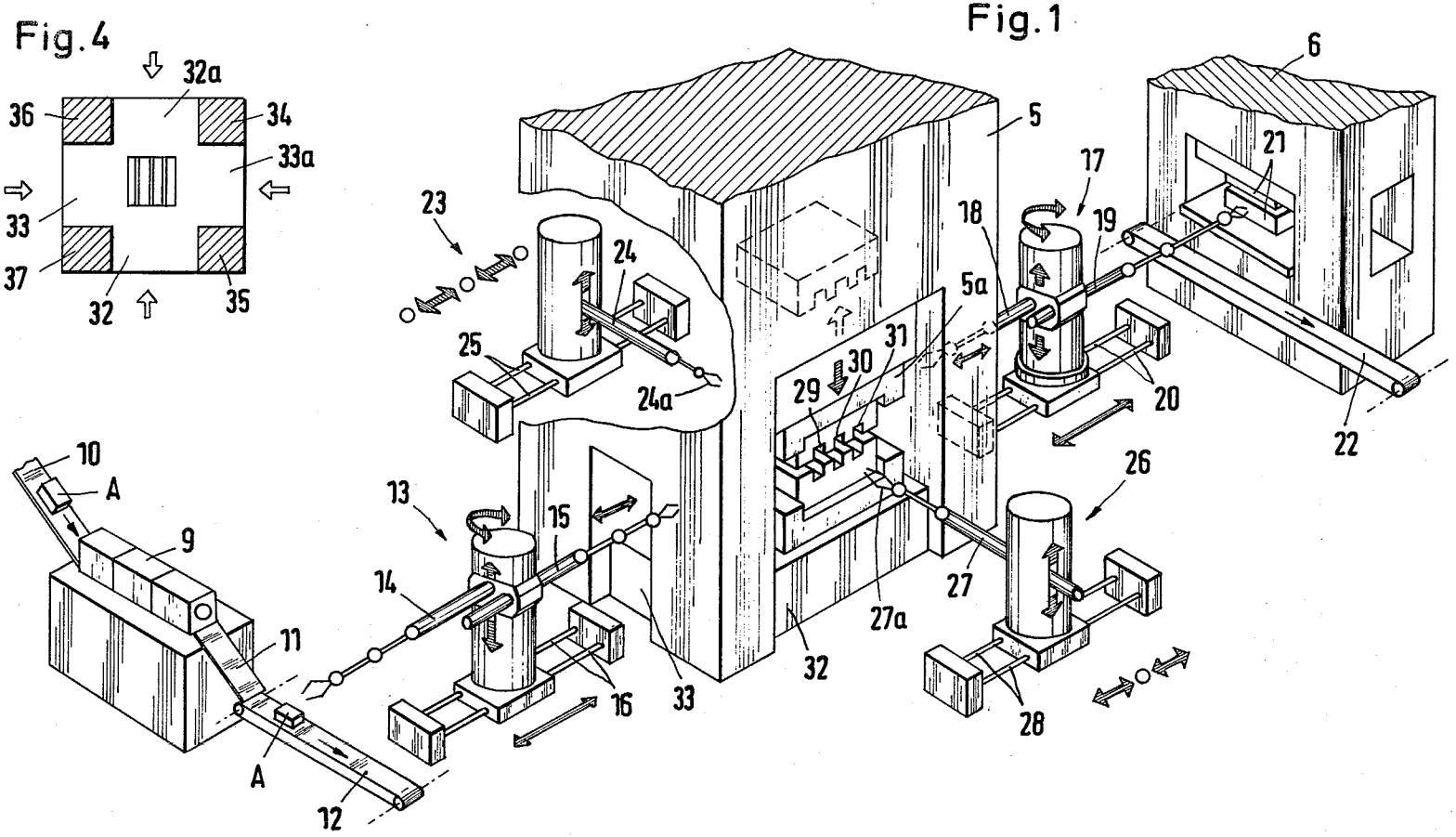
FIG. 1 is a perspective view illustrating the essential parts of the unit.

FIG. 4, on a reduced scale, is a cross-sectional view of the press frame taken at the mold level.

With reference to FIG. 1, the unit comprises a frame 5 for a press ram 5*a*. The frame comprises four vertical columns 34, 35, 36, 37 (FIG. 4) delimiting four openings as respective symmetrical pairs 32, 32*a* and 33, 33*a* adapted to allow the entry and the manoeuvre of the arms of two pairs of robots.

The robot pair 23 and 26 is provided with single arms 24 and 27, respectively, terminating with pliers 24*a* and 27*a* which stand in one or the other of cavities 29, 30, or 31, as will be described below. Robots 23 and 26 are movable step-by-step in the two directions indicated by the arrows, on parallel columns 25 and 28, respectively, having horizontal axes while their arms 24 and 27 are mobile in the two directions in a vertical plane.

Robots 13 and 17, located perpendicular to robots 23 and 26, are each provided with a pair of arms 14, 15 and 18, 19, respectively. Each of the the robots is mobile on columns 16 and 20, respectively, having horizontal axes, and are angularly movable, about a vertical axis, with an alternate rotational movement along an arc of 180°.

Further, the pairs of arms 14, 15 and 18, 19 of robots 13 and 17 are telescopic whereby they may extend and retract for purposes which are described below.

On one side of the press, beyond one of the angularly mobile robots, in the illustrated case the robot 13, a conveyor 12 brings in an orderly succession metallic blocks or billets A. The latter are heated at a suitable temperature and come through the chute 11, from the furnace 9, to which they are delivered by a suitable feeding device.

Beyond the robot 17, at a suitable distance, a trimming press 6 is located and provided with a mold 21 in two parts with respect to which the arms 18 and 19 of robot 17 manoeuver.

The two pairs of robots are programmed in order to effect a series of movements and sequential operations comprising the working cycle. The two robots 23 and 26 move in synchronism and both groups of robots make the same movements and operations in a manner which may be defined as a "mirror-image" relationship.

Robot 13 draws a billet A off conveyor 12 and lays it on part 8 (FIG. 3) of the mold. Robot 17 draws the part coming out of the last mold station and lays it between the parts 21 of the trimming machine 6. Therefore, the arms 14 and 15 of robot 13 and the arms 18 and 19 of robot 17 are connected to hydraulic and/or pneumatic devices which make them telescopically movable.

Furthermore, all the unit kinematic parts are subject to automatic intervention control and security devices, capable of interrupting the operative cycle at any point of its activity, should any anomaly occur.

The operation of the unit is as follows:

The billet A coming from the furnace 9 arrives on the chain conveyor 12, which is provided with detectors to sense the presence and the temperature of part A. If billet A is at a suitable temperature, it stops against a checking device which is deactivated if the temperature of the piece is not as desired, or in the case where an unforseeable emergency occurs in the remaining parts of the unit; in such case, the part or billet A is rejected.

During the normal course of an operative cycle, the terminal pliers of arm 14 (or 15) which is in the open position and located over the billet A, receives a sequence control, whereby the common support of the two arms 14 and 15 lowers and in succession, the pliers close on the billet A, lock it, and the support raises. The robot 13 rotates through 180° and carries the billet A in front of the opening 33 of the press. At the same time, the pneumatic cylinder of arm 14 and the hydraulic cylinder of robot 13 move forward inside the opening 33 until the billet A is brought to the position 29 (FIG. 1) onto the part 8 of the mold, laying it thereon.

As soon as the terminal pliers of arm 14 leave the part A, the same arm rises and withdraws together with the robot 13. The arm 15, which in the meantime has assumed the position previously occupied by the arm 14, if it receives the operative instruction, repeats sequentially the movements just described for arm 14. The angular 180° movement of the robot 13 is reciprocating, whereby the angular movements thereof (and likewise for the robot 17) correspond always to working active phases.

Figure 2:
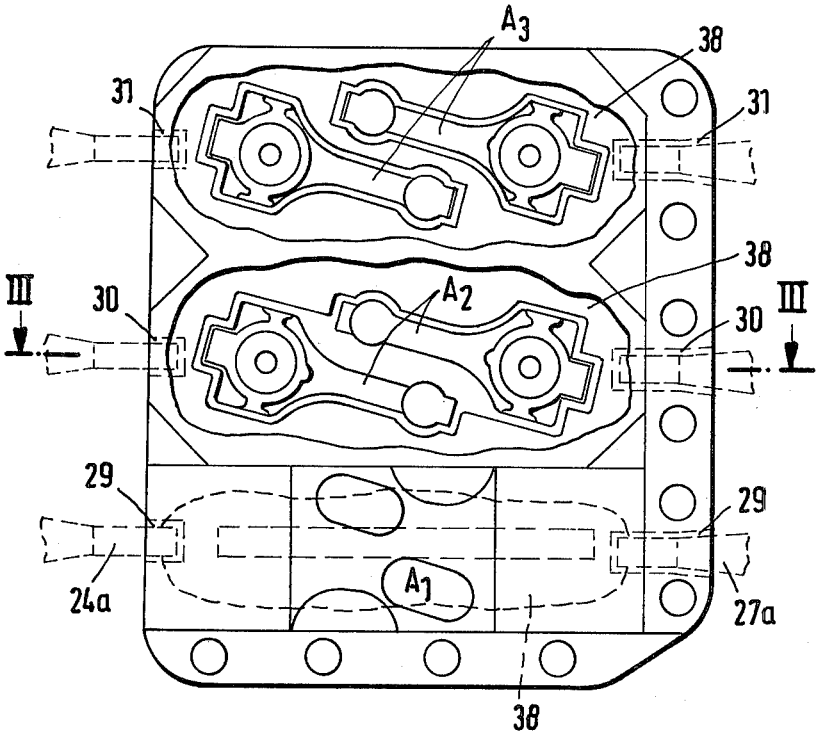
FIG. 2 is a top plan view of the lower part of the mold, which is nearly identical to the upper part.
Figure 3:
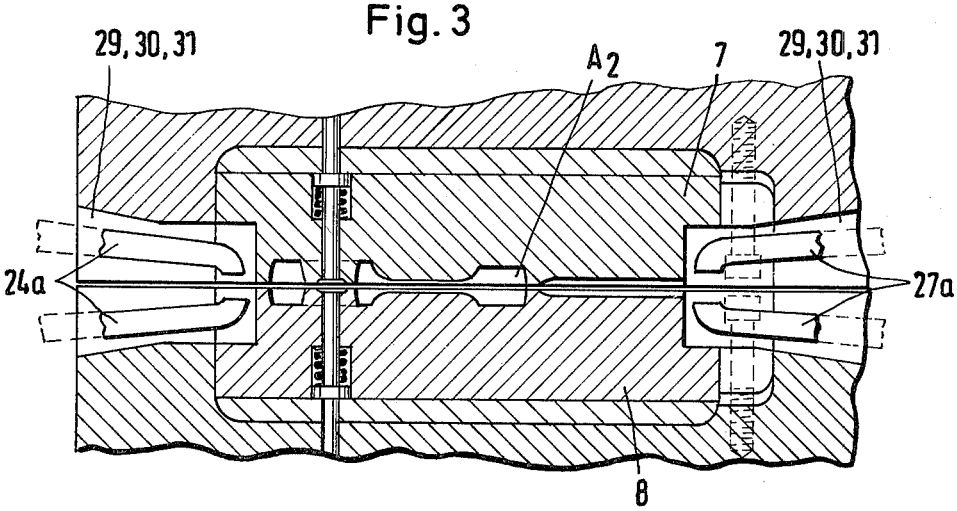
FIG. 3 is a cross-sectional view taken along line III—III of FIG. 2.

The pliers 24*a* and 27*a* of robots 23 and 26, during this phase, lie open in the cavities symmetrically opposed, formed in the two parts of the mold (FIGS. 1 to 3). The retraction of the arm 14 or 15 operates the descent of the ram 5*a* of press 5 together with the upper mobile part 7 of the mold which operates the first phase of the molding cycle producing the flattening of the billet (FIG. 2, part A1). As is known, the volume of the billet A is such as to be suitably excessive with respect to the volume of the cavities when the mold is closed so as to generate a part provided with a perimetric flashing 38 overflowing from the cavity and penetrating between the open ends of pliers 24*a* and 27*a* (FIG. 2). In the automatic sequence, the ram 5*a* rises; the pliers 24*a* and 27*a* close on the flashing 38 while the corresponding arms 24 and 27 experience a lifting movement in the vertical direction; in a rapid succession the two robots 23 and 26 move one step of such an amplitude as to bring the semi-manufactured part A1 to the second station.

When that position has been reached, the arms of the robots 23 and 26 lower, whereby their terminal pliers penetrate into the cavity 30 of the mold part 8. Subsequently, the pliers 24*a* and 27*a* open automatically while the ram effects the second descending stroke. When the ram 5*a* rises again automatically, the robots 23 and 26, by means of their respective arms, repeat the already described cycle whereby the semi-manufactured part arrives in the position indicated by A3 in FIG. 2.

Then, the ram 5*a* of the press effects the third and last descent which concludes a molding cycle. When the ram 5*a* effects the re-ascending stroke, the pliers 24*a* and 27*a* rise together with the part A3 that they retain. Expellers 39 provide for detaching the part from the mold cavity.

At the conclusion of this phase, the arm 18 or 19 of the robot 17, located before the opening 33*a* (FIG. 4), projects its terminal pliers to grasp the perimetric flash 38 of part A3. The pliers 24*a* and 27*a* open sequentially while the arm 18 or 19 of robot 17 retracts and the same robot moves in the direction of the trimming press 6. The robot advances to such a distance as to allow the arm which retains the molded part, after having effected an angular movement of 180°, to lay down the part between the planes of the press 21. Subsequently, the terminal pliers of the arm are opened and thereafter the ram of press 6 lowers and effects the trimming of the molded element.

The molded element is automatically discharged into a container by means of a mechanism controlled by the ram of press 6. Thereafter, the ram of press 6 moves up while the terminal pliers of arm 18 or 19 closes again on the sheared flash which is separate from the part. The arm then retracts, and when it reaches a position vertically over the conveyor 22, it releases the flash which is then discharged.

The described cycle, wholly automatic, is accomplished within a very short time of about six seconds.

All the phases of the cycle, including the sequential movements of the various members, are interdependent and controlled by one or more mocroprocessors. If more than one microprocessor is used, they are programmed to operate in synchronism.

The movement of each kinematic member of the unit is subject to the control of proximity sensors, which provide the consent to the kinematic following phase only when the preceding one has been correctly actuated. Any eventual operation anomaly causes immediate stopping of the operative cycle. Concerning specifically robots 13 and 17, they are programmed to rapidly retract their respective arms from the press 5 area which receives the consent to effect the working stroke only when the retracting movement has been effected.

The robot arms 24 and 27, which may be defined as operative robots because they provide the repetitive step-by-step repetitive translation of the workpiece, are provided with ducts for lubricating and washing the mold cavities. The activation of those ducts, in addition to being automatic, may be effected or protracted by the operator who can intervene with a remote control which temporarily interrupts the automatic cycle of the unit.

The invention has been shown and described in preferred form only, and by way of example, and many variations may be made in the invention which will still be comprised within its spirit. It is understood, therefore, that the invention is not limited to any specific form or embodiment except insofar as such limitations are included in the appended claims.

I claim:

1. A unit for automatically hot molding and trimming metal parts comprising:

a molding press having two opposed and relatively movable mold parts, the mold parts defining between them a series of molding stations, each of the stations including a mold cavity portion in one of the mold parts opposite a corresponding mold cavity portion in the other mold part and two notches in each mold part adjacent to, and on opposite sides of, each mold cavity portion, a pair of robots located on opposite sides of the molding press, each robot having an arm terminating in a gripping means adapted to grasp the flashing produced on a workpiece being operated upon by the molding press, and each robot having means for moving its arm from one molding station to the next in sequence and in synchronization with movement of the other robot arm, the notches being so sized and shaped that at each molding station, the end of each gripping means, carried by each arm, is fully accommodated within the opening defined by two opposed notches in the mold parts when the mold parts are closed, so that the arms need not be moved prior and subsequent to closing of the mold parts when a molding operation is performed on a workpiece, and means for trimming the workpiece after it has been operated upon in the last of the series of molding stations.

2. A unit as defined in claim 1 including means for providing a hot workpiece, and a second pair of robots arranged along an axis perpendicular to the axis along which the first-mentioned pair of robots are located, each of the second pair of robots having two arms arranged at 180° to each other and being rotatable through an angle of 180° about a vertical axis, one of the second pair of robots being between the workpiece providing means and the molding press, and the other of the second pair of robots being between the molding press and the trimming means.

3. A unit as defined in claim 2 wherein the molding press includes a frame having four columns located at the corners of a quadrilateral, each pair of columns defining an opening between them, one of the two pairs of robots being located adjacent to each opening.

4. A unit as defined in claim 1 wherein the means for moving each robot arm from one molding station to the next is so operatively associated with the other such means that the two robot arms move in mirror-image relation, so that each workpiece is grasped by the gripping means of both robot arms as it is moved from molding station to molding station by the robots.

* * * * *